United States Patent [19]

Matson

[11] Patent Number: 4,823,516

[45] Date of Patent: Apr. 25, 1989

[54] CUTTING TOOL WHEEL HAVING A REMOVABLE ABRASIVE BELT

[75] Inventor: Charles B. Matson, Cincinnati, Ohio

[73] Assignee: Cincinnati Milacron Inc., Cincinnati, Ohio

[21] Appl. No.: 190,912

[22] Filed: May 6, 1988

[51] Int. Cl.[4] ..... B24D 9/04

[52] U.S. Cl. ..... 51/367

[58] Field of Search ..... 51/358, 364, 367, 368, 51/370, 374, 380, 384, 385, 387; 29/118; 76/81.1; 101/410, 415.1

[56] References Cited

U.S. PATENT DOCUMENTS

| | | | |
|---|---|---|---|
| 879,504 | 2/1908 | Wattles | 51/367 |
| 891,857 | 6/1908 | Perry . | |
| 967,592 | 8/1910 | Wattles . | |
| 1,800,805 | 4/1931 | Pinkney . | |
| 2,046,122 | 6/1936 | Hunt | 51/194 |
| 2,265,581 | 12/1941 | Stahl | 51/364 |
| 3,203,074 | 8/1965 | Monaghan | 29/118 |
| 3,690,075 | 9/1972 | Schoonmaker | 51/368 |
| 4,250,810 | 2/1981 | Fowler et al. | 101/410 |
| 4,426,931 | 1/1984 | Vogt | 101/415.1 |

OTHER PUBLICATIONS

"CALM–A New Coated Abrasive Precision Grinding System Using Diamond and Cubic Boron Nitride Abrasives", Roger C. Lokken et al, Industrial Abrasives Division/3M (no date).

*Primary Examiner*—Robert P. Olszewski

*Attorney, Agent, or Firm*—Thomas M. Farrell; Frank C. Leach

[57] ABSTRACT

A grinder has an abrasive belt removably mounted on a wheel for grinding a workpiece. The belt has its ends extend through a transverse slot in the wheel into a recess within the wheel. One end of the belt is attached to a first slider and the other end of the belt is attached to a second slider with the sliders increasing the tension on the ends of the belt through outward movement of the sliders by centrifugal force as the wheel rotates with the tension increasing as the angular velocity of the wheel increases. The sliders may move parallel to each other or along two separate radii extending from the axis of rotation of the wheel. Pivotally mounted pendulums may be employed instead of the sliders to apply tension to each end of the belt with the pendulums increasing the tension on the ends of the belt through outward movement of the pendulums by centrifugal force created by rotation of the wheel.

18 Claims, 5 Drawing Sheets

CUTTING TOOL WHEEL HAVING A REMOVABLE ABRASIVE BELT

FIELD OF THE INVENTION

This invention relates to a cutting tool having a rotatable wheel with a removable abrasive belt thereon for removing material from a workpiece and, more particularly, to a cutting tool having a rotatable wheel with a removable abrasive belt thereon in which the tension on each end of the belt is increased during rotation of the wheel

BACKGROUND OF THE INVENTION

It has previously been suggested to replace a grinding wheel of a grinder with a rotatable wheel having a diamond or cubic boron nitride (CBN) coated abrasive strip or belt removably mounted thereon To enable the abrasive strip to be capable of generating precision surfaces and fine finishes on a workpiece, the abrasive strip must be held on the wheel so that it always firmly engages the circumferential surface of the wheel during rotation of the wheel irrespective of the speed of rotation o the wheel.

One previously suggested means of holding a coated abrasive laminate material (CALM) strip of diamond or CBN on the wheel has been to form a rim on the wheel with a large recess or cavity inside of the rim. The wheel has only a hub, which mounts the wheel on the drive shaft of the grinder, within the recess. The rim has a transverse slot providing communication from the recess to exterior of the circumferential surface of the wheel so that the two ends of the CALM strip can enter into the recess. One end of the CALM strip is fastened by an eccentric lock, which tightens through centrifugal force during rotation of the wheel. The other end of the CALM-strip is brought towards the center of the wheel and wrapped around a roller so that the end of the strip is pointed outwardly from the axis of rotation This end of the strip is attached to a metal having a specific mass and positioned close to the roller to provide for the maximum distance for any stretching of the CALM strip Rotation of the wheel causes this floating mass, through centrifugal force, to provide tension on one end of the CALM strip to keep it in its proper position. A counterbalance weight is employed to offset and correct the imbalance created by the floating mass, the roller, and the eccentric lock.

Thus, this previously suggested arrangement for retaining the CALM strip only applies a tension to one end of the CALM strip. There is no recognition of maintaining a tension on each end of the CALM strip.

Because the floating mass attached to one end of the CALM strip is free to move around after the wheel stops rotating, this mass may end up in a position in which the CALM strip is no longer wrapped around the roller. This would depend upon the position of the floating mass when the wheel stops rotating. As a result, the floating mass probably would not return to the desired position when the wheel again begins to rotate. Additionally, this unrestrained movement of the floating mass during rotation creates undesired noise.

The retention of a removable abrasive strip or belt of a rotatable wheel for a sanding machine has previously been suggested in each of U.S Pat. Nos. 1,800,805 to Pinkney and 891,857 to Perry. The retaining mechanism for the removable strip or belt of each of the aforesaid Pinkney and Perry patents includes a plurality of springs and is relatively complex and costly. The complex and costly mechanism also creates balance problems as the speed of rotation of the wheel increases. The aforesaid Pinkney patent has both ends of the belt attached to a single set of jaws that produces a tension primarily on one end of the belt as the jaws move in response to rotation of the wheel. The aforesaid Perry patent has each end of the belt attached to a separate set of jaws but only one set of jaws moves in response to rotation of the wheel to produce a tension on the end of the belt attached thereto Each of U.S. Pat. Nos. 967,592 to Wattles and 879,504 to Wattles has a grinding or polishing wheel with a strip of a flexible abrasive material detachably secured thereto and having an adjustable tension applied to one end. The other end of the strip of each of the aforesaid Wattles patents has a beaded end for retaining it in position. This beaded end clamping arrangement is not deemed to be capable of holding the end of a strip when the wheel is subjected to a relatively high speed because the abrasive strip tends to want to move away from the circumferential surface of the wheel due to the increased centrifugal force created thereon. Furthermore, the other end of the strip of each of the aforesaid Wattles patents has a bead for retaining it in the tension applying means. It is questioned that this beaded end will remain in position to enable any stretching of the belt to be taken up by the tension supplying means.

U.S. Pat. No. 2,046,122 to Hunt discloses a buffing and polishing wheel having a cushion on its circumferential surface and on which an abrasive strip is mounted for polishing a workpiece. This arrangement cannot be used for grinding since a substantially rigid backing surface is required for the abrasive strip to bear against when grinding. This substantially rigid backing surface is not required in buffing or polishing because there is no removal of metal from a workpiece in buffing or polishing but only an improvement of the surface finish or texture of the workpiece. The aforesaid Hunt patent also has one end fixed so that tension can be applied only to one end of the strip.

When the one end of the belt is fixed a in each of the aforesaid Wattles patents, the aforesaid Perry patent, and the aforesaid Hunt patent, there is a frictional resistance when the belt is pulled on the circumferential surface of the rotatable wheel. As the wheel rotates, the tension force becomes greater while the force on the fixed end does not increase. This creates a diminishing tension near the fixed end so that the belt may move radially outwardly from the circumferential surface of the wheel due to centrifugal force, particularly as the speed of rotation of the wheel increases.

As the belt is used, it tends to stretch Since this slack can occur anywhere along the entire length of the belt, the application of a single tension force at one end of the belt may not remove all of the slack from the belt during use. If this occurs, satisfactory grinding will not occur.

In U.S. Pat. No. 3,203,079 to Monaghan, a flexible sheet has its leading or trailing edge or both clamped on a rotatable drum by a clamping strip mounted on the exterior of the rotatable drum; this cannot be used for cutting metal from a workpiece because of the presence of the clamping strip. The clamping in Monaghan of the edge or edges of the sheet occurs on the exterior of the rotating drum.

U.S. Pat. No. 4,250,810 to Fowler et al utilizes a centrifugal clamp for holding a sheet of paper wrapped around a rotating drum. The clamp either extends exterior of the drum or the drum has a very large slot Neither configuration can be employed for retaining an abrasive strip on a wheel for grinding since the transverse slot in the wheel must be as small as possible to reduce the amount of marking on the workpiece created by the absence of the abrasive strip at the slot.

The presently available CALM strips are only flexible in one direction. That is, the strip can only bend with its abrasive surface as its outer surface in the manner necessary for the CALM strip to be mounted on the circumferential surface of the rotating wheel. However, the presently available CALM strips cannot be bent in the opposite direction whereby the abrasive surface would be the inner surface of the strip. Accordingly, with the presently available CALM strips, they must not be passed around a curved surface so that they are bent in a direction whereby the abrasive surface of the CALM strip becomes the inner surface If this occurs, the CALM strip will break

SUMMARY OF THE INVENTION

The present invention satisfactorily overcomes the foregoing problems through providing a cutting tool having a rotatable wheel with a removable abrasive strip or belt thereon. Each end of the strip or belt is subjected to a tension that will maintain the strip or belt tightly against the circumferential surface of the wheel. Tension is applied to both ends of the strip or belt by having separated means engageable with each end of the strip or belt to exert a tension thereon in accordance with the speed of rotation of the wheel. As the speed of rotation increases, the tension on each end of the belt is increased by each of the engageable means since they are subjected to a centrifugal force, which increases as the speed of rotation increases Therefore, by increasing the tension exerted on each end of the strip or belt as the rotational speed of the wheel increases, the strip or belt is held tightly against the circumferential surface of the wheel.

This is accomplished by a relatively simple mechanism of a pair of engageable mean attached to the ends of the abrasive strip or belt and movable in response to the centrifugal force produced by the rotation of the wheel. Thus, as the centrifugal force increases, the engageable means increase the tension on each end of the strip or belt. The engageable means are disposed within a recess or cavity in the wheel.

In the preferred embodiments, the path of the abrasive belt from the circumferential surface of the wheel to its attachment to each of the engageable means is selected so that the abrasive surface always remains as the outer surface of the belt during any change of the path of the belt to enable the end of the belt to be attached to the engageable means. Accordingly, when the belt is a CALM strip, the arrangement of its path in the preferred embodiments will not break through efforts to bend it in a direction in which the abrasive surface becomes the inner surface of the belt.

It should be understood that other types of abrasive strips or belts might be capable of bending in both directions whereby the abrasive surface can be either the inner or outer surface of the strip or belt during bending. These strips or belts would not require the path of the strip or belt to be controlled as does the CALM strip.

An object of this invention is to provide a cutting wheel having a removable strip or belt thereon capable of removing material.

Another object of this invention is to maintain a material removing strip or belt in position on a rotatable wheel during rotation of the wheel.

A further object of this invention is to provide an adjustable tension on each end of a material removing strip or belt removably mounted on a rotatable wheel.

Other objects of this invention will be readily perceived from the following description, claims, and drawings.

BRIEF DESCRIPTION OF THE DRAWINGS

The attached drawings illustrate preferred embodiments of the invention, in which.

DESCRIPTION OF THE PREFERRED EMBODIMENTS

Figure 1:
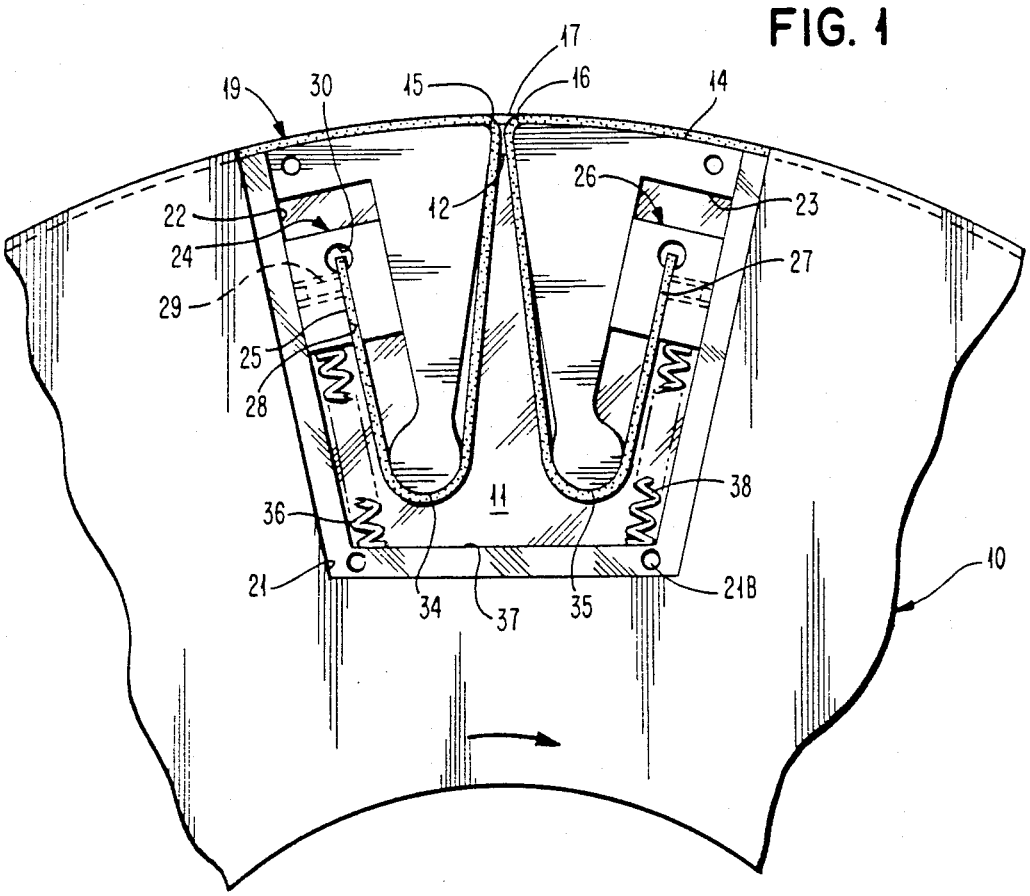
FIG. 1 is a fragmentary side elevational view of a portion of a rotatable wheel having a removable abrasive belt mounted thereon with a adjustable tension applied to each of its ends by sliders in accordance with the speed of rotation of the wheel.

Referring to the drawings and particularly FIG. 1, there is shown a rotatable wheel 10 for mounting in a grinder on a wheelhead or grinding spindle. The grinder preferably has automatic dynamic balancing of the rotatable wheel 10 during rotation thereof.

A recess or cavity 11 is formed in a portion of the wheel 10. The wheel 10 has a relatively small transverse slot 12 extending from its circumferential surface 14 to the recess 11 to provide communication of the recess 11 with the exterior of the circumferential surface 14 of the rotatable wheel 10.

Figure 2:
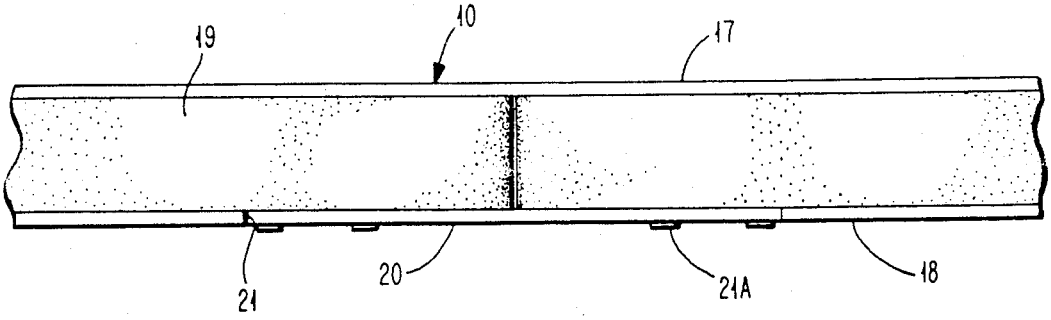
FIG. 2 is a fragmentary end elevational view of a portion of the wheel of FIG. 1 and showing a side cover positioned thereon.

The entrance of the slot 12 is defined by a pair of curved surfaces 15 and 16. The circumferential surface 14 of the rotatable wheel 10 has a pair of guide flanges 17 (see FIG. 2) and 18 between which an abrasive belt or strip 19 is positioned. One suitable example of the belt 19 is a CALM strip sold by 3M.

A side cover 20 is disposed within a shallow recess 21 (see FIG. 1), which surrounds three sides of the recess 11, in the wheel 10. The side cover 20 (see FIG. 2) is secured to the wheel 10 by screws 21A extending into threaded holes 21B (see FIG. 1) in the portion of the wheel 10 having the shallow recess 21. The side cover 20 (see FIG. 2) forms a part of the guide along with the guide flange 18 for one side of the belt 19. The guide flange 18 is omitted where the side cover 20 functions as part of the guide.

The recess 11 (see FIG. 1) has a first chamber 22 and a second chamber 23. The chambers 22 and 23 are formed along two separate radii extending from the axis of rotation of the wheel 10. The first chamber 22 has a slider 24 slidably mounted therein and having an end 25 of the belt 19 attached thereto. The second chamber 23 has a slider 26, which is the same as the slider 24, slidably supported therein and attached to an end 27 of the belt 19. The first chamber 22 functions as a guide for the slider 24, and the second chamber 23 functions as a guide for the slider 26.

Each of the sliders 24 and 26 preferably is a single block. The slider 24 has a slot 28 therein to receive the end 25 of the belt 19 with a set screw 29 retaining the end 25 of the belt 19 within the slot 28. The slider 24 has a hole 30 drilled therethrough to reduce the total mass of the slider 24.

The mass of the slider 24 must be selected so that the tension applied to the end 25 of the belt 19 will not be so large as to cause the belt 19 to break when the wheel 10 is rotating at its maximum speed. The reduction in the total mass of the slider 24 by a specific percentage reduces the tension by the same percentage, and this reduction can result in the tension not exceeding the maximum that will break the belt 19 when the wheel 10 is rotating at its maximum speed.

The mass of the slider 26 is selected so that it is the same as the mass of the slider 24. Thus, the same adjustable tension is applied to the end 27 of the belt 19 by the slider 26 as is applied to the end 25 of the belt 19 by the slider 24.

Figure 3:
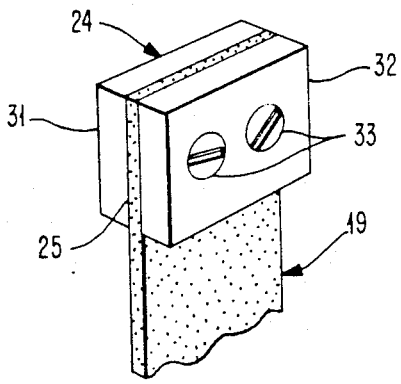
FIG. 3 is a perspective view of another form of a slider for use with the wheel of FIG. 1 and to which the end of the belt is attached.

If it is not necessary to precisely control the mass of the sliders 24 and 26 because of the strength of the belt 19, then the slider 24 may be formed, for example, as shown in FIG. 3, of two separate blocks 31 and 32 attached to each other by a pair of screws 33. The screws 33 also extend through the end 25 of the belt 19 to attach the belt 19 to the slider 24. The slider 26 (see FIG. 1) would be similarly formed so that the same adjustable tension would be applied to each of the ends 25 and 27 of the belt 19.

The recess 11 has a curved wall 34 to guide the belt 19 to change its direction of movement approximately 180° without causing it to break and maintaining its abrasive surface as the outer surface while enabling it to be connected to the slider 24. The recess 11 has a curved wall 35 around which a portion of the belt 19 passes prior to the end 27 of the belt 19 being secured to the slider 26 to prevent the belt 19 from breaking as it is bent around the curved wall 35.

A compression spring 36 extends between the slider 24 and a wall 37 of the recess 11 to exert a force urging the slider 24 outwardly. A compression spring 38 extends between the slider 26 and the wall 37 of the recess 11 to exert a force urging the slider 26 outwardly. If the belt 19 has sufficient stiffness to reduce slack when the wheel 10 is not rotating, the springs 36 and 38 may be omitted since they are used to take up the slack in the belt 19.

The tension exerted on the end 25 or 27 of the belt 19 is determined by the centrifugal force, which is defined by $F=mrw^2$ where F is the centrifugal force created on the slider 24 or 26 by rotation of the wheel 10, m is the mass of the slider 24 or 26, r is the distance of the slider 24 or 26 from the axis of rotation of the wheel 10, and w is the angular velocity of the wheel 10. With the masses of the sliders 24 and 26 equal, the same tension would be exerted on each of the sliders 24 and 26. Thus, the maximum centrifugal force is determined by the maximum angular velocity of the wheel 10. Therefore, each of the sliders 24 and 26 must have its mass selected to insure that the tension produced by the maximum angular velocity of the wheel 10 is less than the tension that will break the belt 19.

Figure 4:
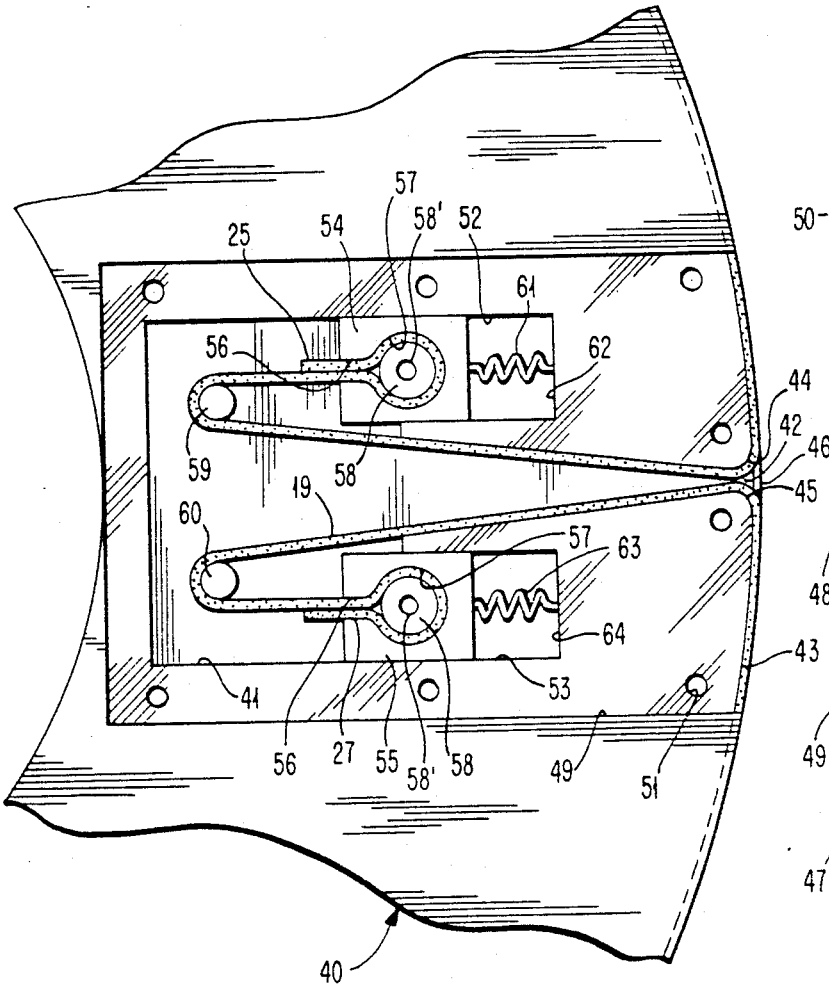
FIG. 4 is a fragmentary side elevational view of a portion of a rotatable wheel having a removable abrasive belt mounted thereon and showing another arrangement for mounting the sliders attached to the ends of the abrasive belt for applying adjustable tensions.

Referring to FIG. 4, there is shown a rotatable wheel 40 for mounting in a grinder on a wheelheador grinding spindle. The grinder preferably has automatic dynamic balancing of the rotatable wheel 40 during rotation.

A recess or cavity 41 is formed in a portion of the wheel 40. The wheel 40 has a relatively small transverse slot 42 extending from its circumferential surface 43 to the recess 41 to provide communication of the recess 41 with the exterior of the circumferential surface 43 of the rotatable wheel 40.

The entrance of the slot 42 is defined by a pair of curved surfaces 44 and 45. The circumferential surface 43 of the rotatable wheel 40 has a pair of guide flanges 46 (see FIG. 5) and 47 between which the abrasive belt 19 is positioned.

A side cover 48 is disposed within a shallow recess 49 (see FIG. 4), which surrounds the recess 41, in the wheel 40. The side cover 48 (see FIG. 5) is secured to the wheel 40 by screws 50 extending into threaded holes 51 (see FIG. 4) in the portion of the wheel 40 having the shallow recess 49. The side cover 48 (see FIG. 5) forms a part of the guide along with the guide flange 47 for one side of the belt 19. The guide flange 47 is omitted where the side cover 48 functions as part of the guide.

The recess 41 (see FIG. 4) has a first chamber 52 and a second chamber 53. The first chamber 52 has a slider 54 slidably mounted therein and attached to the end 25 of the belt 19. The second chamber 53 has a slider 55, which is the same as the slider 54, slidably supported therein and attached to the end 27 of the belt 19.

The first chamber 52, which guides the slider 54 during its movement, and the second chamber 53, which guides the slider 55 during its movement, are arranged so that the sliders 54 and 55 move parallel to each other. This parallel motion of the sliders 54 and 55 has a slightly greater resistance to movement by centrifugal force than occurs when the sliders move along radii as the sliders 24 (see FIG. 1) and 26 in the wheel 10 do.

Each of the sliders 54 (see FIG. 4) and 55 is the same. Each of the sliders 54 and 55 includes a block having a slot 56 extending inwardly from an outer surface to a circular shaped chamber 57. Each of the slot 56 and the circular shaped chamber 57 extends between opposite parallel surfaces of the block of each of the sliders 54 and 55.

A clamping pin 58 is disposed within the circular shaped chamber 57 in the slider 54 or 55 after the end 25 or 27 of the belt 19 has been positioned therein after being passed through the slot 56. The clamping pin 58 in the circular shaped chamber 57 in the slider 54 attaches the end 25 of the belt 19 to the slider 54, and the clamping pin 58 in the circular shaped chamber 57 in the slider 55 attaches the end 27 of the belt 19 to the slider 55.

Each of the clamping pins 58 has a threaded hole 58' in one end to receive the end of a screw (not shown) having a turning head. With the clamping pin 58 having the screw attached thereto, grasping of the turning head of the screw enables insertion of the clamping pin 58 into the circular shaped chamber 57. After the clamping pin 58 is in position within the circular shaped chamber 57, the screw is turned to be removed from the threaded hole 58' in the clamping pin 58.

The recess 41 has a fixed circular pin 59 to guide the belt 19 to change its direction of movement approximately 180° for connecting the end 25 of the belt 19 to the slider 54 without causing the belt 19 to break by maintaining its abrasive surface as its outer surface. The recess 41 has a fixed circular pin 60 to guide the belt 19 to change its direction of movement approximately 180° for connecting the end 27 of the belt 19 to the slider 55 without causing the belt 19 to break by maintaining its abrasive surface as its outer surface.

A tension spring 61 extends between the slider 54 and a wall 62 of the first chamber 52 of the recess 41 to exert a force continuously urging the slider 54 outwardly. A tension spring 63 extends between the slider 55 and a wall 64 of the second chamber 53 of the recess 41 to exert a force continuously urging the slider 55 outwardly.

The springs 61 and 63 are utilized to take up any slack in the belt 19 when the wheel 40 is not rotating. If the belt 19 has sufficient stiffness to reduce slack when the wheel 40 is not rotating, the springs 61 and 63 may be omitted if desired.

Figure 6:
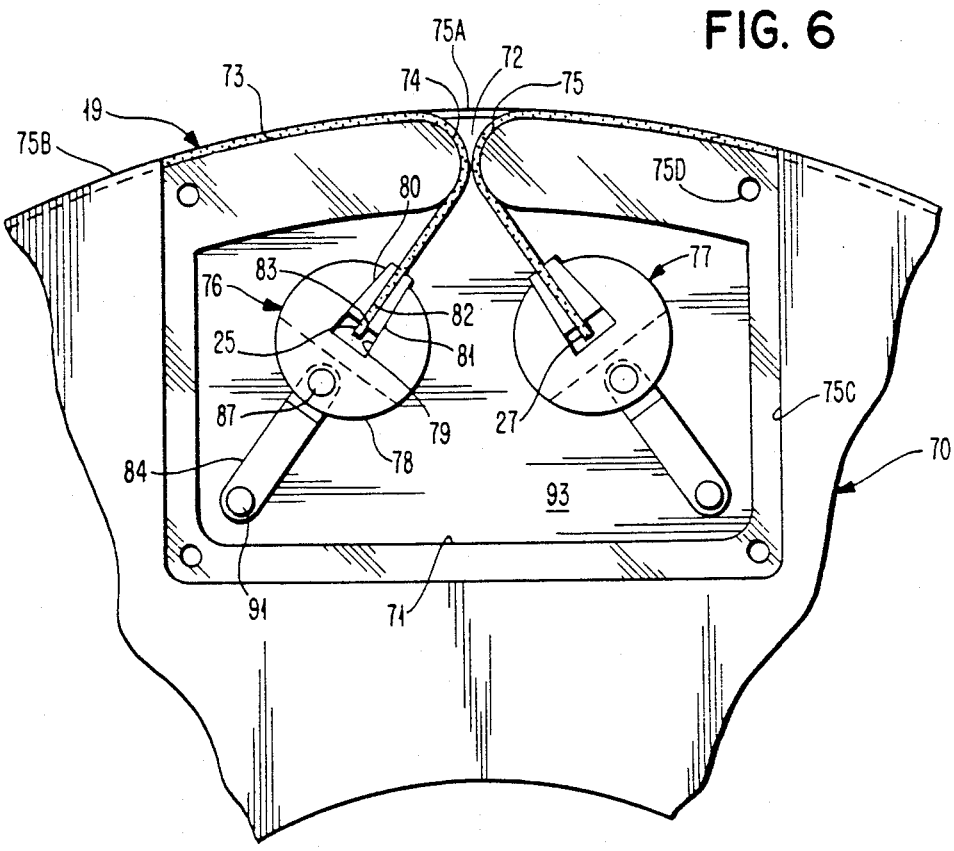
FIG. 6 is a fragmentary side elevational view of a portion of a rotatable wheel having a removable abrasive belt mounted therein with an adjustable tension applied to each end of a belt through pivotally mounted pendulums in accordance with the speed of rotation of the wheel.

Referring to FIG. 6, there is shown a rotatable wheel 70 for mounting in a grinder on a wheelhead or grinding spindle. The grinder preferably has automatic dynamic balancing of the rotatable wheel 70 during rotation.

A recess or cavity 71 is formed in a portion of the wheel 70. The wheel 70 has a relatively small transverse slot 72 extending from its circumferential surface 73 to the recess 71 to provide communication of the recess 71 with the exterior of the circumferential surface 73 of the rotatable wheel 70.

The entrance of the slot 72 is defined by a pair of curved surfaces 74 and 75. The circumferential surface 73 of the rotatable wheel 70 has a pair of guide flanges 75A and 75B between which the abrasive belt 19 is positioned in the same manner as the guide flanges 46 (see FIG. 5) and 47 on the rotatable wheel 40 cooperate with the belt 19.

Figure 5:
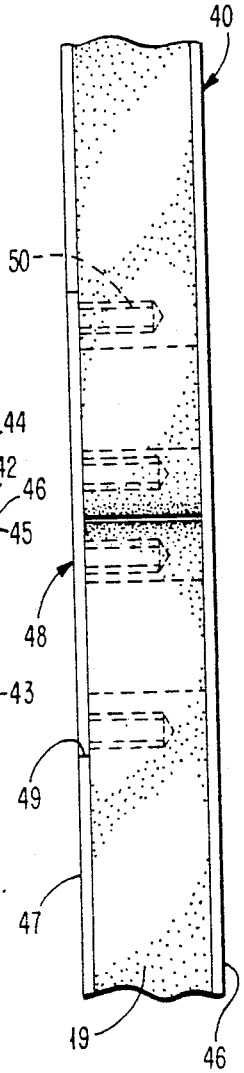
FIG. 5 is a fragmentary end elevational view of the wheel of FIG. 4 and showing a side cover mounted on the wheel.

The wheel 70 (see FIG. 6) has a side cover (not shown) disposed in a shallow recess 75C, which surrounds the recess 71, and secured to the wheel 70 by screws (not shown) extending into threaded holes 75D in the portion of the wheel 70 having the shallow recess 75C in the manner similar to that for the side cover 48 (see FIG. 5). A portion of the side cover for the wheel 70 (see FIG. 6) forms a portion of the guide for the belt 19 along with the guide flange 75B for one side of the belt 19 in the same manner as the guide flange 47 (see FIG. 5) and the side cover 48 cooperate.

The recess 71 (see FIG. 6) has first pendulum means 76 pivotally mounted therein and having the end 25 of the belt 19 attached thereto. The recess 71 has second pendulum means 77 pivotally mounted therein and having the end 27 of the belt 19 attached thereto. Each of the first pendulum means 76 and the second pendulum means 77 is the same.

The first pendulum means 76 includes a cylindrical element 78 having a triangular shaped slot 79 formed therein. A pair of triangular shaped wedges 80 and 81 is disposed within the slot 79 and has flat surfaces 82 (see FIG. 7) and 83, respectively, between which the end 25 (see FIG. 6) of the belt 19 is disposed and held.

The wedges 80 and 81 have their surfaces which engage the sides of the slot 79 in the cylindrical element 78 at an angle between 6° and 10°. This insures self locking of the wedges 80 and 81 within the cylindrical element 78 so that neither the wedge 80 nor the wedge 81 can fall out of the slot 80.

Figure 7:
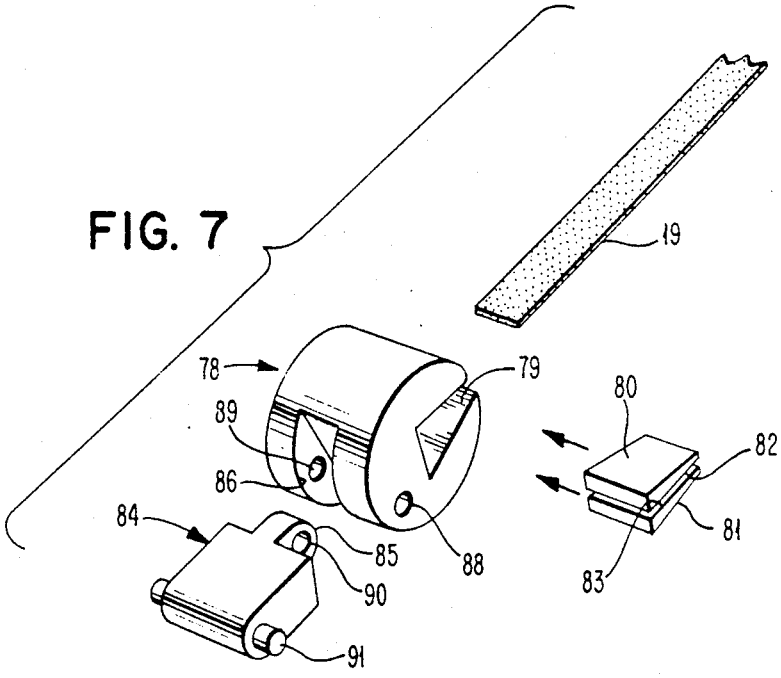
FIG. 7 is an exploded perspective view of portions of one of the pendulums of FIG. 6 and a portion of the belt attached thereto.

The cylindrical element 78 has one end of a link 84 pivotally connected thereto. As shown in FIG. 7, the link 84 has a projection 85 extending into a slot 86 in the cylindrical element 78. A pin 87 (see FIG. 6) extends through aligned passages 88 (see FIG. 7) and 89 in the cylindrical element 78 and a passage 90 in the projection 85 of the link 84 to pivotally connect one end of the link 84 to the cylindrical element 78.

The other end of the link 84 has a pivot pin 91 extending therethrough and beyond opposite sides. One end of the pin 91 is disposed within a blind hole (not shown) in a bottom wall 93 (see FIG. 6) of the recess 71. The other end of the pin 91 (see FIG. 7) is disposed within a hole (not shown) in the side cover (not shown).

As the wheel 70 (see FIG. 6) rotates, the cylindrical element 78 of the first pendulum means 76 moves outwardly to cause the link 84 to rotate counterclockwise about the pivot pin 91. As a result, the wedges 80 and 81 are pulled tighter into the narrower portion of the triangular shaped slot 79 in the cylindrical element 78 to hold the end 25 of the belt 19 tighter. This outward motion of the cylindrical element 78 increases the tension on the end 25 of the belt 19 because it pulls the belt 19 tighter through moving the end 25 of the belt 19 upwardly towards the circumferential surface 73 of the wheel 70. The same result occurs simultaneously with the second pendulum means 77 with the same adjustable tension being applied to the end 27 of the belt 19 because the first pendulum means 76 and the second pendulum means 77 have the same mass.

When the first pendulum means 76 is at rest, the belt engaging surfaces 82 and 83 of the wedges 80 and 81, respectively, are shown in alignment with the axis of the pivot pin 87 and the axis of the pin 91. The same arrangement exists with the second pendulum means 77. However, the stretching of the belt 19 could cause the pivot pin 87 to be lower than shown. A similar arrangement would occur with the second pendulum means 77.

Figure 8:
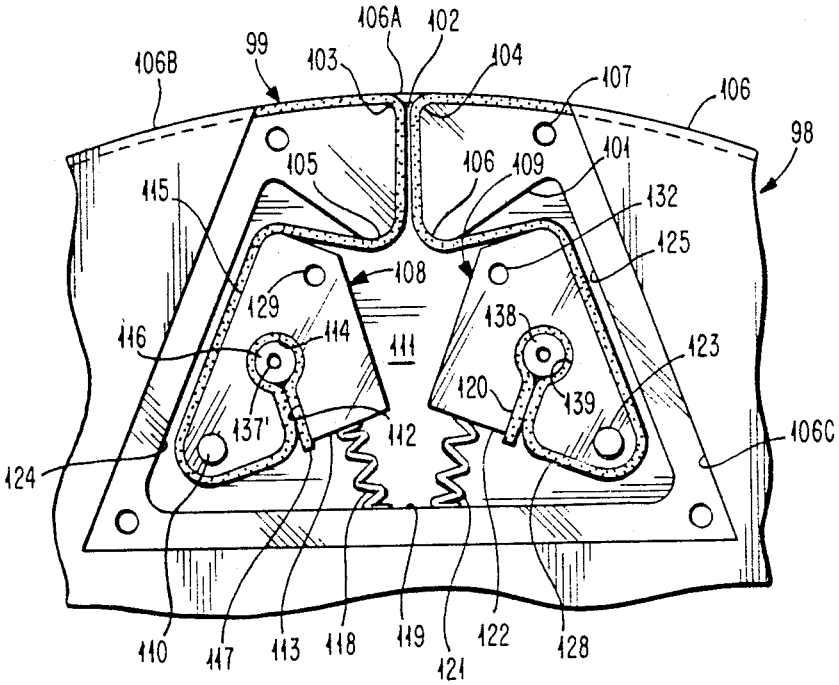
FIG. 8 is an enlarged fragmentary side elevational view of a portion of a rotatable wheel having a removable abrasive belt mounted thereon and showing another embodiment of pivotally mounted pendulums attached to the ends of the abrasive belt for applying adjustable tensions to the ends of the belt.

Referring to FIG. 8, there is shown a rotatable wheel 98 for mounting in a grinder on a wheelhead or grinding spindle. The grinder preferably has automatic dynamic balancing of the rotatable wheel 98 during rotation.

Figure 9:
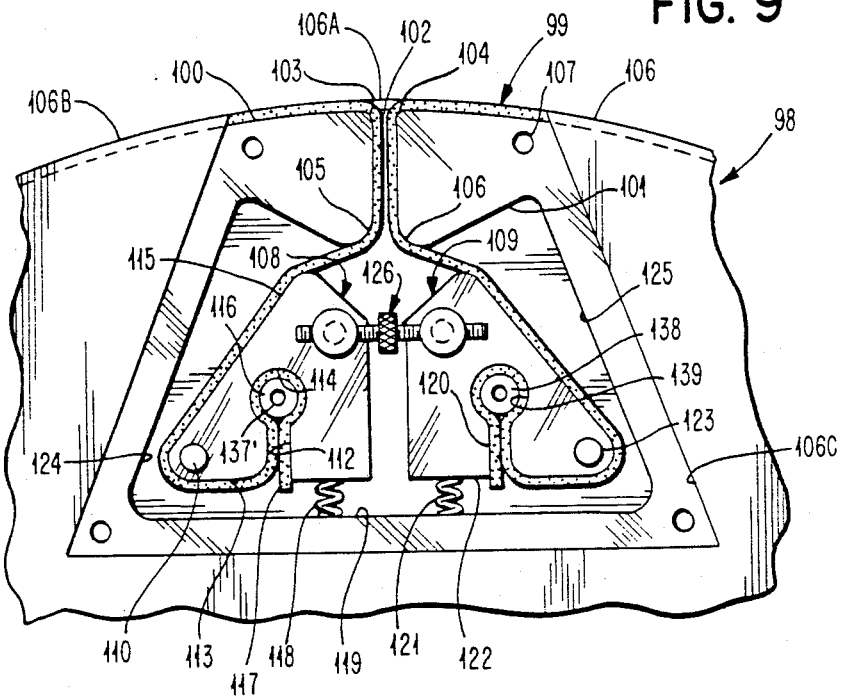
FIG. 9 is an enlarged fragmentary side elevational view, similar to FIG. 8, and showing the pivotally mounted pendulums of FIG. 8 in positions to enable an abrasive belt to be attached thereto.

The rotatable wheel 98 has an abrasive belt 99 wrapped around its circumferential surface 100 (See FIG. 9). The belt 99 is capable of being bent in either direction so that the abrasive surface may form either the inner or outer surface of the belt 99 during bending of the belt 99.

A recess or cavity 101 is formed in a portion of the wheel 98. The wheel 98 has a relatively small transverse slot 102 extending from the circumferential surface 100 to the recess 101 to provide communication of the recess 101 with the exterior of the circumferential surface 100 of the rotatable wheel 98.

The entrance of the slot 102 is defined by a pair of curved surfaces 103 and 104. The exit of the slot 102 into the recess 103 is defined by a pair of curved surfaces 105 and 106, which have a substantially larger radius of curvature than the curved surfaces 103 and 104.

The circumferential surface 100 of the rotatable wheel 98 has a pair of guide flanges 106A and 106B between which the abrasive belt 99 is positioned in the same manner a the belt 19 (see FIG. 5) is positioned between the guide flanges 46 and 47. A side cover (not shown) is disposed in a shallow recess 106C (see FIG. 8), which surrounds the recess 101, in tee wheel 98 and secured thereto by screws (not shown) extending into threaded holes 107 in the portion of the wheel 98 having the shallow recess 106C. The side cover (not shown) forms a part of the guide along with the guide flange 106B for one side of the belt 99 in the same manner as the side cover 48 (see FIG. 5) forms a part of the guide along with the guide flange 47 for one side of the belt 19.

The recess 101 (see FIG. 8) has first pendulum means 108 and second pendulum means 109 pivotally mounted therein. Each of the first pendulum means 108 and the second pendulum means 109 has the same mass.

The first pendulum means 108 is a block pivotally mounted on a pivot pin 110, which has its ends supported in a blind hole (not shown) in a bottom wall 111 of the recess 101 and a hole (not shown) in the side cover (not shown). The first pendulum means 108 has a slot 112 extending from its surface 113 to a circular shaped chamber 114.

The belt 99 extends around the curved surface 105 and a surface 115 of the first pendulum means 108 and a portion of the surface 113 of the first pendulum means 108 into the slot 112 in the first pendulum means 108. A retaining pin 116 is disposed within the circular shaped chamber 114 to hold an end 117 of the belt 99 therein so that the end 117 of the belt 99 is secured to the first pendulum means 108.

A spring 118 is disposed between the surface 113 of the first pendulum means 108 and a wall 119 of the recess 101 to continuously urge the first pendulum means 108 counterclockwise about the pivot pin 110. Thus, a tension is always applied to the end 117 of the belt 99 when the end 117 of the belt 99 is attached to the first pendulum means 108.

The second pendulum means 109 is a mirror image of the first pendulum means 108 and has an end 120 of the belt 99 attached thereto. A spring 121, which acts between a surface 122 of the second pendulum means 109 and the wall 119 of the recess 101, continuously urges the second pendulum means 109 clockwise about a pivot pin 123 on which the second pendulum means 109 is pivotally mounted. Thus, a tension is always applied to the end 120 of the belt 99 when the end 120 of the belt 99 is attached to the second pendulum means 109.

To dispose the first pendulum means 108 and the second pendulum means 109 close enough to each other to attach the ends 117 and 120, respectively, of the belt 99 to the first pendulum means 108 and the second pendulum means 109, respectively, the forces of the springs 118 and 121 must be overcome. This is necessary so that the first pendulum means 108 and the second pendulum means 109 are spaced from walls 124 and 125, respectively, of the recess 101.

Figure 10:
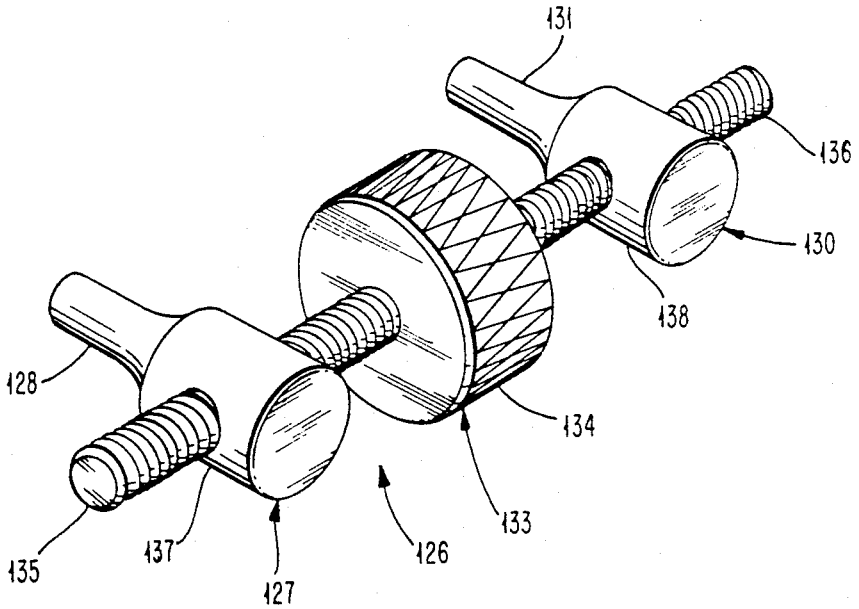
FIG. 10 is an enlarged perspective view of a connector for holding the pendulums in the position of FIG. 9.

A connector 126 (see FIG. 9) is employed to hold the first pendulum means 108 and the second pendulum means 109 in the position of FIG. 9. The connector 126 (see FIG. 10) includes a first retainer 127 having a reduced portion 128 disposed within a hole 129 (see FIG. 8) in the first pendulum means 108 and a second retainer 130 (see FIG. 10) having a reduced portion 131 disposed in a hole 132 (see FIG. 8) in the second pendulum means 109.

The connector 126 (see FIG. 10) includes a one-piece knurled thumb screw 133 having a central knurled cylinder 134 with a first threaded screw 135 extending from one side thereof and a second threaded screw 136, which is threaded in the opposite direction to the first threaded screw 135, extending from the opposite side thereof. The first threaded screw 135 extends into an enlarged portion 137 of the first retainer 127, and the second threaded screw 136 extends into an enlarged portion 138 of the second retainer 130. Rotation of the central knurled cylinder 134 of the thumb screw 133 in one direction moves the first pendulum means 108 (see FIG. 9) and the second pendulum means 109 towards each other to a desired position, as shown in FIG. 9, in which the ends 117 and 120 of the belt 99 can be attached to the first pendulum means 108 and the second pendulum means 109, respectively.

With the first pendulum means 108 and the second pendulum means 109 held close to each other by the connector 126, the ends 117 and 120 of the belt 101 are wrapped around the first pendulum means 108 and the second pendulum means 109, respectively. To retain the end 117 of the belt 99 within the circular shaped chamber 114 in the first pendulum means 108, the retaining pin 116 is inserted after the end 117 of the belt 99 has been inserted into the circular shaped chamber 117 through the slot 112 and then extended out through the slot 112 beyond the surface 113 of the first pendulum means 108.

The retaining pin 116 has a threaded hole 137' in one end to receive the end of a screw (not shown) having a turning head. With the retaining pin 116 having the screw attached thereto, grasping of the turning head of the screw enables insertion of the pin 116 into the circular shaped chamber 114 with a portion of the end 117 of the belt 99 therein. With the retaining pin 116 disposed within the circular chamber 114, the screw is turned to be removed from the threaded hole 137' in the retaining pin 116. A retaining pin 138 is similarly disposed within a circular shaped chamber 139 in the second pendulum means 109.

After the ends 117 and 120 of the belt 99 are attached to the first pendulum means 108 and the second pendulum means 109, respectively, the connector 126 is removed from holding the first pendulum means 108 and the second pendulum means 109 against the forces of the springs 118 and 121. As a result, the first pendulum means 108 and the second pendulum means 109 exert substantially the same tension on the ends 117 and 120, respectively, of the belt 99. As the wheel 98 rotates, the centrifugal force causes counterclockwise pivoting of the first pendulum means 108 about the pivot pin 110 and clockwise pivoting of the second pendulum means 109 about the pivot pin 123. This increases the adjustable tension on the ends 117 and 120 of the belt 99 the same amount because the mass of each of the first pendulum means 108 and the second pendulum means 109 is the same. Therefore, as the centrifugal force increase due to the speed of rotation of the wheel 98 increasing, tension increases on the ends 117 and 120 of the belt 99.

While the present invention has shown and described a grinding wheel having an abrasive belt removably mounted thereon, it should be understood that the present invention may be utilized with any rotatable wheel having a removable abrasive strip for cutting material from a workpiece. It also should be understood that the sliders 24 (see FIG. 1) and 26 may be used in place of the sliders 54 (see FIG. 4) and 55 and that the sliders 54 and 55 may be employed in place of the sliders 24 (see FIG. 1) and 26.

An advantage of this invention is that an abrasive belt is maintained tightly on a rotatable wheel of a grinder at all times. Another advantage of this invention is that substantially the same tension is applied to each end of an abrasive belt removably mounted on a rotatable wheel. A further advantage of this invention is that the expense of grinding workpieces is substantially reduced through not having to replace a relatively expensive grinding wheel after wear since only a relatively inexpensive abrasive belt must be substituted. Still another advantage of this invention is that dressing of the grinding wheel is avoided to also reduce costs.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

I claim:

1. A cutting tool for removing material from a workpiece including:

rotatable means having a substantially rigid circumferential surface;

said rotatable means having a recess therein;

said rotatable means having a transverse slot extending through said circumferential surface to said recess to communicate said recess exterior of said circumferential surface of said rotatable means;

a belt removably mounted on said circumferential surface of said rotatable means, said belt having material removal means for removing material from a workpiece when said belt engages the workpiece during rotation of said rotatable means;

said belt having search of its ends extending through said slot into said recess in said rotatable means;

first engageable means in said recess of said rotatable means engageable with one end of said belt to produce a tension thereon in accordance with the speed of rotation of said rotatable means;

and second engageable means in said recess of said rotatable means engageable with the other end of said belt to produce a tension thereon in accordance with the speed of rotation of said rotatable means.

2. The cutting tool according to claim 1 in which:

said first engageable means includes means in said recess in said rotatable means and movable by centrifugal force in response to rotation of said rotatable means;

and said second engageable means includes means mounted in said recess in said rotatable means and movable by centrifugal force in response to rotation of said rotatable means.

3. The cutting tool according to claim 2 in which:

said mounted means of said first engageable means is movable from its rest position by centrifugal force acting on said mounted means of said first engageable means due to its mass;

and said mounted means of said second engageable means is movable from its rest position by centrifugal force acting on said mounted means of said second engageable means due to its mass.

4. The cutting tool according to claim 2 in which:

said mounted means of said first engageable means includes means slidably mounted in said recess in said rotatable means and having the one end of said belt attached thereto;

and said mounted means of said second engageable means includes means slidably mounted in said recess in said rotatable means and having the other end of said belt attached thereto.

5. The cutting tool according to claim 4 including:

first guide means in said recess for changing the direction of motion of said belt approximately 180° after said belt enters said recess and prior to engagement of said belt with said slidably mounted means of said first engageable means;

and second guide means in said recess for changing the direction of motion of said belt approximately 180° after said belt enters said recess and prior to engagement of said belt with said slidably mounted means of said second engageable means.

6. The cutting tool according to claim 4 in which:

said recess has first means therein to cause said slidably mounted means of said first engageable means to be slidably along a first radius extending from the axis of rotation of said rotatable means when moved by centrifugal force in response to rotation of said rotatable means;

and said recess has second means therein to cause said slidably mounted means of said second engageable means to be slidable along a second radius extending from the axis of rotation of said rotatable means when moved by centrigual force in response to rotation of said rotatable means.

7. The cutting tool according to claim 6 including:

first guide means in said recess for changing the direction of motion of said belt approximately 180° after said belt enters said recess and prior to engagement of said belt with said slidably mounted means of said first engageable means;

and second guide means in said recess for changing the direction of motion of said belt approximately 180° after said belt enters said recess and prior to engagement of said belt with said slidably mounted means of said second engageable means.

8. The cutting tool according to claim 4 including:

first resilient means within said recess for continuously urging said slidably mounted means of said first engageable means outwardly along the first radius;

and second resilient means within said recess for continuously urging said slidably mounted means of said second engageable means outwardly along the second radius.

9. The cutting tool according to claim 8 in which:

said recess has a plurality of walls;

said first resilient means engages said slidably mounted means of said first engageable means and one of said walls of said recess;

and said second resilient means engages said slidably mounted means of said second engageable means and one of said walls of said recess.

10. The cutting tool according to claim 8 in which:

said slidably mounted means of said first engageable means is movable from its rest position to which said slidably mounted means of said first engageable means is continuously urged by said first resilient means solely by centrifugal force acting on said slidably mounted means of said first engageable means due to its mass;

and said slidably mounted means of said second engageable means is movable from its rest position to which said slidably mounted means of said second engageable means is continuously urged by said second resilient means solely be centrifugal force acting on said slidably mounted means of said second engageable means due to its mass.

11. The cutting tool according to claim 8 including:

first guide means in said recess for changing the direction of motion of said belt approximately 180° after said belt enters said recess and prior to engagement of said belt with said slidably mounted means of said first engageable means;

and second guide means in said recess for changing the direction of motion of said belt approximately 180° after said belt enters said recess and prior to engagement of said belt with said slidably mounted means of said second engageable means.

12. The cutting tool according to claim 2 in which:

said mounted means of said first engageable means includes first pendulum means pivotally mounted in said recess in said rotatable means and having the one end of said belt attached thereto;

said mounted means of said second engageable means includes second pendulum means pivotally mounted in said recess in said rotatable means and having the other end of said belt attached thereto;

said first pendulum means being movable in response to rotation of said rotable means to increase the tension on the one end of said belt;

and said second pendulum means being movable in response to rotation of said rotatable means to increase the tension on the other end of said belt;

said first pendulum means an said second pendulum means being movable in opposite directions in response to rotation of said rotatable means.

13. The cutting tool according to claim 12 in which:

said first pendulum means includes:

a block disposed within said recess; pivotal connecting means disposed within said recess to pivotally connect said block to said rotatable means;

said block having chamber means therein to receive one end of said belt;

means disposed within said chamber means to attach said belt to said block;

and resilient means disposed within said recess for continuously urging said block about said pivotal connecting means in the same direction as said block moves when subjected to centrifugal force due to its mass in response to rotation of said rotatable means;

and said second pendulum means further;

a block disposed within said recess;

pivotal connecting means disposed within said recess to pivotally connect said block to said rotatable means;

said block having chamber means therein to receive the other end of said belt;

means disposed within said chamber means to attach said belt to said block;

and resilient means disposed within said recess for continuously urging said block about said pivotal connecting means in the same direction as said block moves due to its mass when subject to centrifugal force in response to rotation of said rotatable means.

14. The cutting tool according to claim 13 including means to hold said block of said first pendulum means and said block of said second pendulum means closer to each other by overcoming said resilient means of each of said first pendulum means and said second pendulum means whereby the one end of said belt may be disposed in said chamber means of said first pendulum means and the other end of said belt may be disposed in said chamber means of said second pendulum means.

15. A cutting tool for removing material from a workpiece including:

rotatable means having a substantially rigid circumferential surface;

said rotable means having a recess therein;

said rotable means having a transverse slot extending through said circumferential surface to said recess to communicate said recess exterior of said circumferential surface of said rotatable means;

a belt removably mounted on said circumferential surface of said rotatable means, said belt having material removal means for removing material from a workpiece when said belt engages the workpiece during rotation of said rotatable means;

said belt having each of its ends extending through said slot into said recess in said rotatable means;

first engageable means in said recess of said rotatable means engageable with one end of said belt to produce a tension thereon in accordance with the speed of rotation of said rotatable means;

second engageable means in said recess of said rotatable means engageable with the other end of said belt to produce a tension thereon in accordance with the speed of rotation of said rotable means;

said first engageable means including means mounted in said recess in said rotable means and movable by centrifugal force in response to rotation of said rotatable means;

said second engageable means including means mounted in said recess in said rotatable means and movable by centrifugal force in response to rotation of said rotable means;

said mounted means of said first engageable means including means slidably mounted in said recess in said rotable means and having the one end of said belt attached thereto;

said mounted means of said second engageable means including means slidably mounted in said recess in said rotable means and having the other end of said belt attached thereto;

said recess having first means therein to guide said slidably mounted means of said first engageable means;

said recess having second means therein to guide said slidably mounted means of said second engageable means;

and said first and second means cooperating to guide said slidably mounted means of said first engageable means and said slidably mounted means of said second engageable means parallel to each other during sliding movement in response to rotation of said rotable means.

16. The cutting tool according to claim 15 including:

first resilient means within said recess for continuously urging said slidably mounted means of said first engageable means outwardly;

and second resilient means within said recess for continuously urging said slidably mounted means of said second engageable means outwardly.

17. A cutting tool for removing material from a workpiece including:

rotatable means having a substantially rigid circumferential surface;

said rotatable means having a recess therein;

said rotatable means having a transverse slot extending through said circumferential surface to said recess to communicate said recess exterior of said circumferential surface of said rotable means;

a belt removably mounted on said circumferential surface of said rotatable means, said belt having material removal means for removing material from a workpiece when said belt engages the workpieced during rotation of said rotable means;

said belt having each of its ends extending through said slot into said recess in said rotatable means;

first engageable means in said recess of said rotatable means engageable with one end of said belt to produce a tension thereon in accordance with the speed of rotation of said rotatable means;

said engageable means in said recess of said rotable means engageable with the other end of said belt to produce a tension thereon in accordance with the speed of rotation of said rotable means;

said first engageable means including means mounted in said recess in said rotable means and movable by centrifugal force in response to rotation of said rotatable means;

said second engageable means including means mounted in said recess in said rotatable means and movable by centrifugal force in response to rotation of said rotatable means;

said mounted means of said first engageable means including first pendulum means pivotally mounted in said recess in said rotatable means and having the one end of said belt attached thereto;

said mounted means of said second engageable means including second pendulum means pivotally mounted in said recess in said rotatable means and having the other end of said belt attached thereto;

said first pendulum means being movable in response to rotation of said rotatable means to increase the tension on the one end of said belt;

said second pendulum means being movable in response to rotation of said rotatable means to increase the tension on the other end of said belt;

said first pendulum means including:

a cylindrical element;

means supported by said belt to said cylindrical element;

a link;

first pivotal means to pivtally connect one end of aid link to said cylindrical element;

and second pivotal means to pivotally connect the other end of said link to said rotatable means;

and said second pendulum means including:

a cylindrical element;

means supported by said cylindrical element for attaching the other end of said belt to said belt to said cylindrical element;

a link;

first pivotal means to pivotally connect the one end of said link to said cylindrical element;

and second pivotal means to pivotally connect the other end of said link to said rotatable means.

18. The cutting tool according to claim 17 in which:

said cylindrical element of each of said first pendulum means and said second pendulum means has a substantially triangular shaped slot extending inwardly from its circumference;

and said supported means of each of said first pendulum means and said second pendulum means includes a pair of substantially triangular shaped wedges having belt engaging surfaces between which said belt is disposed, said pair of wedges being smaller than said substantially triangular shaped slot so as to be slidable in said substantially triangular shaped slot in said cylindrical element.

* * * * *